US010641056B2

(12) United States Patent
Saeed et al.

(10) Patent No.: US 10,641,056 B2
(45) Date of Patent: May 5, 2020

(54) HIGH-EXPANSION PACKER ELEMENTS

(71) Applicants: Ahmed Mohamed Saeed, Cypress, TX (US); Joze John Hrupp, Montgomery, TX (US)

(72) Inventors: Ahmed Mohamed Saeed, Cypress, TX (US); Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 94 days.

(21) Appl. No.: 16/012,987

(22) Filed: Jun. 20, 2018

(65) Prior Publication Data

US 2019/0390529 A1 Dec. 26, 2019

(51) Int. Cl.
*E21B 33/128* (2006.01)
*E21B 33/12* (2006.01)

(52) U.S. Cl.
CPC ..... *E21B 33/1208* (2013.01); *E21B 33/128* (2013.01)

(58) Field of Classification Search
CPC . E21B 33/128; E21B 33/1208; E21B 33/1212
See application file for complete search history.

(56) References Cited

U.S. PATENT DOCUMENTS

| | | | | |
|---|---|---|---|---|
| 2,339,319 | A * | 1/1944 | Brightwell | E21B 33/128 417/109 |
| 2,945,541 | A | 7/1960 | Maly et al. | |
| 3,472,520 | A * | 10/1969 | Burns | E21B 33/1212 277/339 |
| 7,316,271 | B2 | 1/2008 | Moyes | |
| 7,578,354 | B2 | 8/2009 | Thomson | |
| 8,967,281 | B2 | 3/2015 | Gandikota et al. | |
| 9,243,473 | B2 | 1/2016 | Yang et al. | |
| 9,441,449 | B1 | 9/2016 | Abi Aad | |
| 9,617,818 | B2 | 4/2017 | Kocurek et al. | |
| 2006/0186602 | A1* | 8/2006 | Martin | E21B 17/07 277/338 |
| 2013/0161000 | A1 | 6/2013 | Broussard et al. | |

* cited by examiner

*Primary Examiner* — Cathleen R Hutchins
(74) *Attorney, Agent, or Firm* — J. Bennett Mullinax, LLC

(57) ABSTRACT

A high-expansion packer element is injection molded from chemical-resistant elastomers and provided with multiple upsets in an inner surface of the sidewall to relieve stress as the high-expansion packer element is compressed and held in a set condition.

3 Claims, 4 Drawing Sheets

HIGH-EXPANSION PACKER ELEMENTS

CROSS REFERENCE TO RELATED APPLICATIONS

This is the first application for this invention.

FIELD OF THE INVENTION

This invention relates in general to packer elements for providing annular fluid seals in wellbores and, in particular, to a novel high-expansion packer element adapted for use in providing annular fluid seals in open borehole and cased wellbores.

BACKGROUND OF THE INVENTION

Packer elements are essential for subterranean well completion and hydrocarbon production. They are used to establish and maintain an annular fluid seal between an inner tubular and a surrounding wall, which may be an outer tubular or an open borehole. Achieving a reliable annular fluid seal can be challenging, especially in expanded or eroded casing and open boreholes, each of which may have an inconsistent internal diameter due to any number of uncontrollable factors. Furthermore, although open borehole completions are generally considered to be advantageous from a cost perspective and are known to have hydrocarbon production advantages, cased and cemented wellbore completions have become commonplace because the cemented annulus provides a secure seal between the production casing and the wellbore and stabilizes the casing, making establishing and maintaining an annular seal in the cased and cemented wellbore more reliable and dependable than in an open wellbore.

Numerous designs and formulations for packer elements are known. In the past, packer elements were made from chemical-resistant elastomers but those packer elements had limited expansion capacity. In order to provide a more expansive packer element for use between a production casing and an open wellbore, swellable packer elements were invented and have become widely used for open wellbore completions. Swellable packer elements contain fluid absorbing compounds that expand as they absorb certain well fluids to provide an annular seal between the production casing and the open wellbore. However, long term absorption of the well fluids can compromise the strength of the swellable packer element and eventually result in a loss of packer element integrity and a failure of the annular seal.

There therefore exits a need for a high-expansion packer element that is readily manufactured using known, non-absorptive packer element elastomers.

SUMMARY OF THE INVENTION

It is therefore an object of the invention to provide a high-expansion packer element that overcomes the shortcomings of the prior art.

The invention therefore provides a high-expansion packer element, comprising a hollow cylindrical body having, a first end, a second end, a smooth outer surface, and a sidewall having an inner surface, the inner surface of the sidewall including first and second U-shaped upsets to relieve internal stress as the high-expansion packer element is compressed to a packer set condition.

The invention further provides a high-expansion packer element, comprising a hollow cylindrical body having a first end, a second end, an outer surface, and a sidewall having an inner surface, the inner surface of the sidewall including first, second and third U-shaped upsets to relieve internal stress as the high-expansion packer element is compressed to a packer set condition.

The invention yet further provides a high-expansion packer element, comprising a hollow cylindrical body having a first end, a second end, an outer surface, and a sidewall having an inner surface, the inner surface of the sidewall including first and second upsets with transverse grooves interconnecting the first and second upsets to relieve internal stress as the high-expansion packer element is compressed to a packer set condition.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
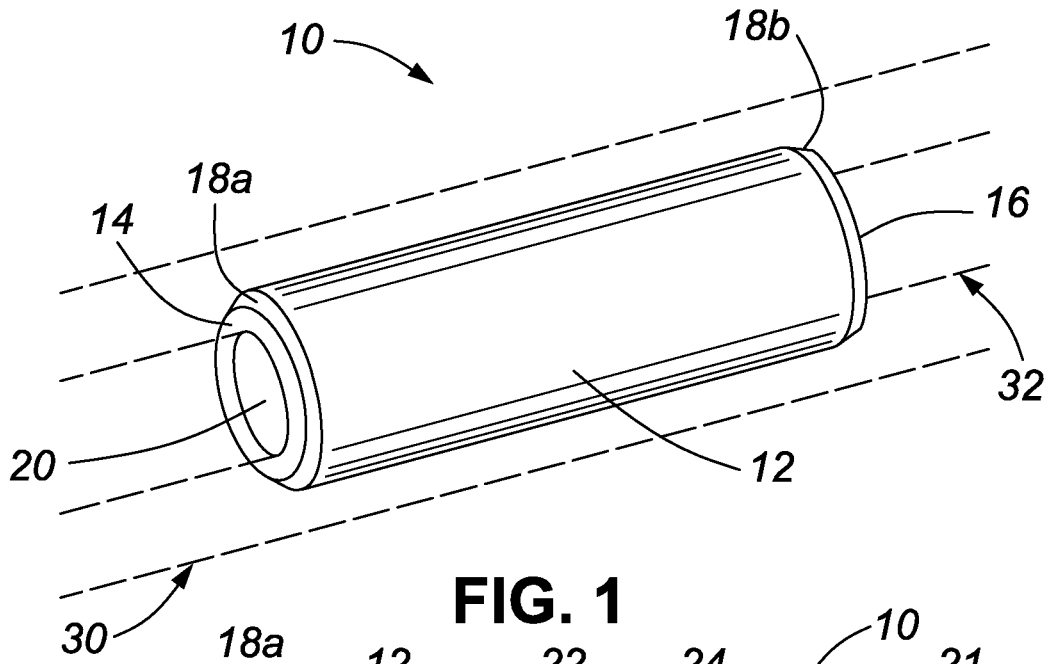
FIG. 1 is a perspective view of one embodiment of a high-expansion packer element in accordance with the invention.

The invention provides a high-expansion packer element for use in open and cased wellbore completions, downhole tool mandrels, packers, plugs, etc. The packer element is typically injection molded using conventional packer element elastomeric compounds. There are no metal or composite components embedded within the high-expansion packer elements. The high-expansion packer elements achieve a more uniform highly expanded diameter along a length of the packer element by having multiple bulge-initiating locations. The bulge-initiating locations are provided by spaced-apart upsets in an internal surface of the packer element sidewall. The upsets provide space for the packer element to expand, yielding stress relief in the packer element. The longevity of the packer element is thereby increased and reliability of the annular seal is enhanced. Each packer element in accordance with the invention is engineered to expand to about the same maximum extent and provide as much sealing area as possible, with less internal strain than prior art packer elements. The high-expansion packer elements may be compressed to as little as 40% of their relaxed state length, which yields up to about a 140% expansion of the relaxed condition outer diameter of the packer element without loss of a high-pressure fluid seal against an inner tubular carrying the packer element.

| Part No. | Part Description |
|---|---|
| 10 | packer element (first embodiment) |
| 12 | Outer surface |
| 14 | First end |
| 16 | Second end |
| 18a, 18b | Beveled shoulders |
| 20 | Inner surface |
| 22 | First internal upset |
| 22a, 24b | Radiused edges |
| 24 | Second internal upset |
| 24a, 24b | Radiused edges |
| 30 | Outer wall |
| 32 | Inner tubular |
| 40 | packer element (second embodiment) |
| 42 | Outer surface |
| 44 | First end |
| 46 | Second end |
| 48a, 48b | Beveled shoulders |
| 50 | Inner surface |
| 52 | First Internal upset |
| 52a, 52b | Radiused edges |
| 54 | Second internal upset |
| 54a, 54b | Radiused edges |
| 56 | Third internal upset |
| 56a, 56b | Radiused edges |
| 60 | packer element (third embodiment) |
| 62 | Outer surface |
| 64 | First end |
| 66 | Second end |
| 68a, 68b | Beveled shoulders |
| 70 | Inner surface |
| 72 | First external upset |
| 74 | Second external upset |
| 75 | First internal upset |
| 75a, 75b | Radiused edges |
| 76 | Second internal upset |

-continued

| Part No. | Part Description |
|---|---|
| 76a, 76b | Radiused edges |
| 78 | Third internal upset |
| 78a, 78b | Radiused edges |
| 80 | packer element (fourth embodiment) |
| 82 | Outer surface |
| 84 | First end |
| 86 | Second end |
| 88a, 88b | Beveled shoulders |
| 90 | Inner surface |
| 92 | First internal upset |
| 92a | Radiused edge |
| 94 | Second internal upset |
| 94a | Radiused edge |
| 96a-96f | Transverse grooves |
| 98a-98f | Lands between transverse grooves |

The packer elements, in accordance with the invention, described below with reference to FIGS. 1-4 are typically injection molded, as noted above. Suitable elastomeric compounds for molding the packer elements include, but are not limited to: HNBR—Hydrogenated nitrile butadiene rubber, which is known for its physical strength and retention of properties after long-term exposure to heat, oil and chemicals; FKM—a synthetic rubber and fluoropolymer elastomer that is about 80% of fluoroelastomers sold under brand names such as Viton®; and EPDM—Ethylene propylene diene monomer, a type of synthetic rubber of the polymethylene type having a wide range of applications.

FIG. 1 is a perspective view of one embodiment of a high-expansion packer element 10 in accordance with the invention in a relaxed (unset) condition. The packer element 10 is a hollow cylindrical body with a smooth outer surface 12, a first end 14 and a second end 16. The first end 14 has a beveled shoulder 18*a* and the second end 16 has a beveled shoulder 18*b*. The packer element 10 also has a sidewall 21 (see FIG. 1B) with an inner surface 20.

Figure 1A:
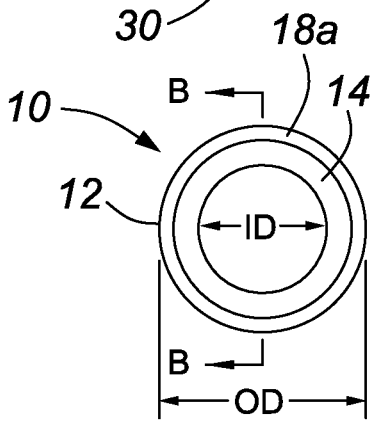
FIG. 1A is an end view of the high-expansion packer element shown in FIG. 1.

FIG. 1A is an end view of the high-expansion packer element 10 shown in FIG. 1, in the relaxed condition. In the relaxed condition the packer element 10 has an internal diameter (ID) that is dependent on an outer diameter of a tubular or mandrel that carries the packer element 10, which may be, by way of example, a production casing, production tubing, packer mandrel, downhole tool mandrel, or the like. In the relaxed condition the packer element 10 also has an outer diameter (OD). The outer diameter of the packer element 10 is dependent on an inner diameter of a tubular or open wellbore in which the packer element 10 is to be set to provide an annular seal.

Figure 1B:
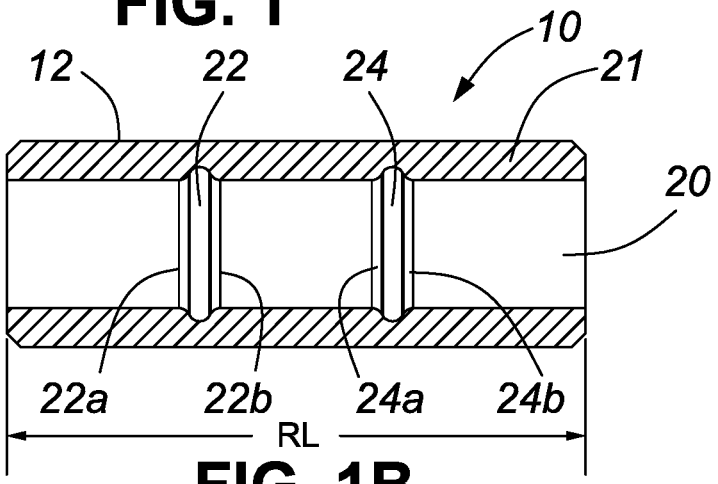
FIG. 1B is a cross-sectional view of the high-expansion packer element shown in FIG. 1, taken along lines B-B shown in FIG. 1A.

FIG. 1B is a cross-sectional view of the high-expansion packer element 10 shown in FIG. 1, taken along lines B-B shown in FIG. 1A. The inner surface 20 of the packer element 10 includes a first internal upset 22 having first and second radiused edges 22*a*, 22*b*, and a second internal upset 24 having radiused edges 24*a* and 24*b*. In this embodiment, the first internal upset 22 and the second internal upset 24 are substantially U-shaped, and a depth of the respective internal upsets 22, 24 is about 40% of the total thickness of the sidewall 21 of the packer element 10. The respective internal upsets 22, 24 partition the inner surface 20 into three substantially equal sections. The first internal upset 22 and the second internal upset 24 are engineered to provide stress relief in the packer element 10 as it is set (compressed in length using hydraulic and/or mechanical means) to provide an annular seal. The internal upsets 22, 24 facilitate stress-reduced expansion of the outer diameter (OD) of up to about 140%. In the relaxed condition, the packer element 10 has a relaxed length (RL). The relaxed length is dependent on a function to be served by the packer element 10, a minimum length required to accommodate the upsets 22, 24, and an optional compressed (packer set) target length.

Figure 1C:
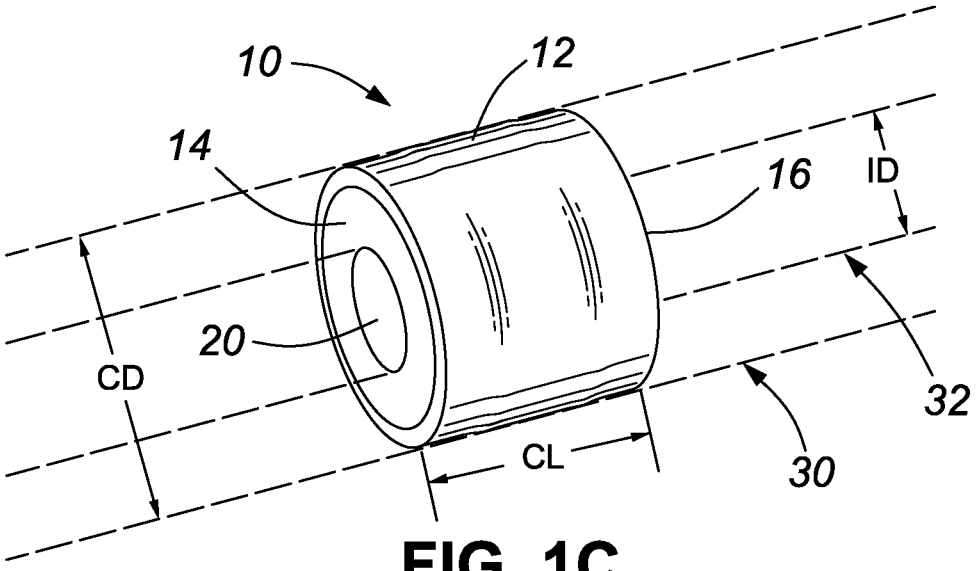
FIG. 1C is a perspective view of the high-expansion packer element shown in FIG. 1 in a compressed, packer set, condition.

FIG. 1C is a perspective view of the high-expansion packer element 10 shown in FIG. 1 in the compressed, packer set, condition. In the compressed, packer set, condition shown in FIG. 1C, the packer element 10 is at maximum engineered compression. A compressed length (CL) of the packer element 10 may be as little as 40% of the relaxed length (RL) of the packer element 10 without compromising an integrity of the packer element 10, and a compressed diameter (CD) of the packer element 10 at maximum engineered compression expands to as much as 140% of the outer diameter (OD) of the packer element 10 shown in FIG. 1 in the relaxed condition. The internal diameter (ID) remains unchanged as the packer element 10 is compressed to the packer set condition.

Figure 2:
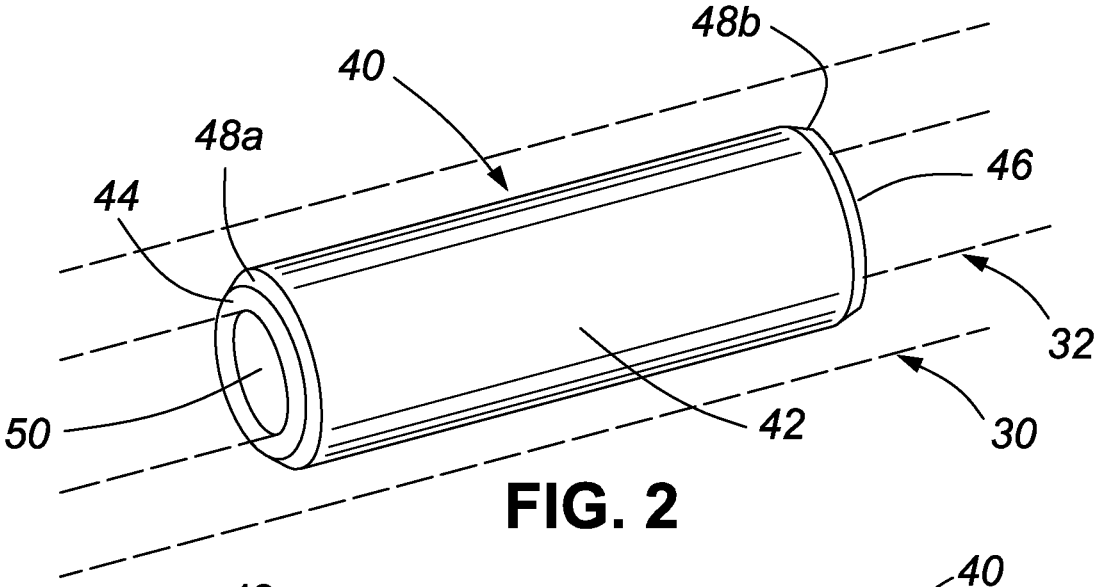
FIG. 2 is a perspective view of another embodiment of a high-expansion packer element in accordance with the invention.

FIG. 2 is a perspective view of a second embodiment of a high-expansion packer element 40 in accordance with the invention. The packer element 40 is a hollow cylindrical body with a smooth outer surface 42, a first end 44 and a second end 46. The first end 44 has a beveled shoulder 48*a* and the second end 46 as a beveled shoulder 48*b*. The packer element 40 also has a sidewall 51 (see FIG. 2B) having an inner surface 50.

Figure 2A:
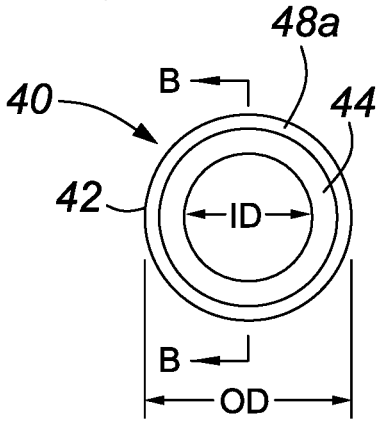
FIG. 2A is an end view of the high-expansion packer element shown in FIG. 2.

FIG. 2A is an end view of the high-expansion packer element 40 shown in FIG. 2, showing the packer element 40 in the relaxed condition. In the relaxed condition the packer element 40 has an internal diameter (ID) that is dependent on an outer diameter of a tubular or mandrel that carries the packer element 40. In the relaxed condition the packer element 40 also has an outer diameter (OD). The outer diameter of the packer element 40 is dependent on an inner diameter of a tubular or wellbore in which the packer element 40 is to provide an annular seal.

Figure 2B:
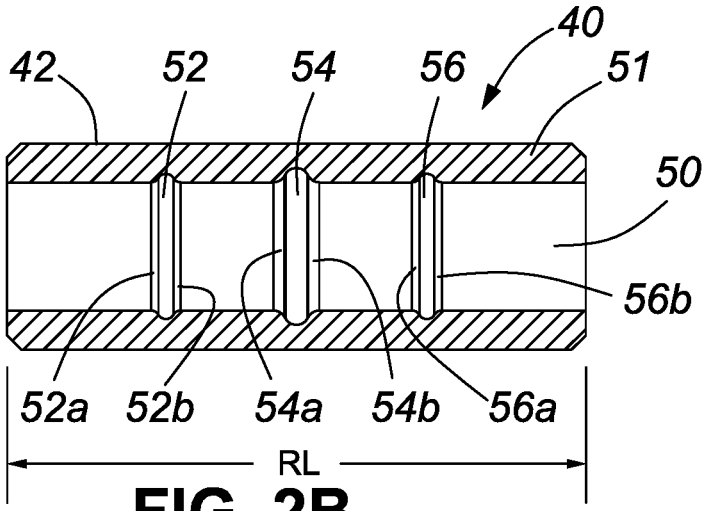
FIG. 2B is a cross-sectional view of the high-expansion packer element shown in FIG. 2, taken along lines B-B shown in FIG. 2A.

FIG. 2B is a cross-sectional view of the high-expansion packer element 40 shown in FIG. 2, taken along lines B-B of FIG. 2A. The inner surface 50 of the packer element 40 includes a first internal upset 52 having first and second radiused edges 52*a*, 52*b*, a second internal upset 54 having radiused edges 54*a*, 54*b*, and a third internal upset 56 having radiused edges 56*a*, 56*b*. The second internal upset 54 is about 50% larger than the first internal upset 52 and the third internal upset 56. In this embodiment, the respective internal upsets 52, 54 and 56 are generally U-shaped, and the first internal upset 52 and third internal upset 54 have a depth of about 20% of a thickness of the sidewall 51 of the packer element 40, while the second internal upset 54 has a depth that is about 40% of a thickness of the sidewall 51. In this embodiment, the second internal upset 54 is centered in the inner surface 50, and a center of each of the first internal upset 52 and the third internal upset 56 is spaced from a center of the second internal upset 54 by a distance that is about 25% of a total length of the inner surface 50. The first internal upset 52, second internal upset 54 and the third internal upset 56 are likewise engineered to provide stress relief in the packer element 10 as it is compressed to provide an annular seal, as well as to permit an expansion of the outer diameter (OD) of up to at least about 140% of the outer diameter in the relaxed condition. In the relaxed condition, the packer element 10 has a relaxed length (RL). The relaxed length is, within above-noted constraints, a matter of design choice dependent at least in, part on a function to be served by the packer element 10.

Figure 2C:
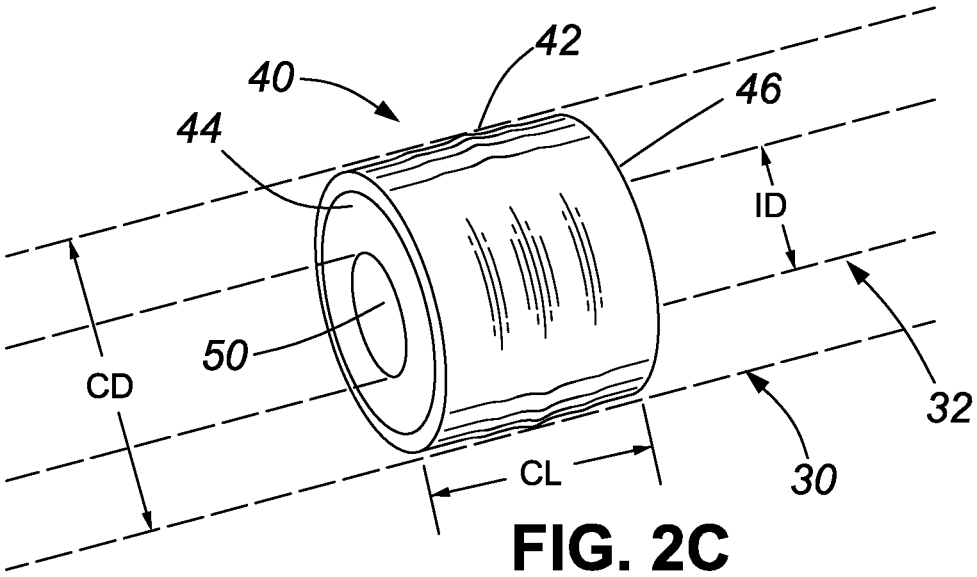
FIG. 2C is a perspective view of the high-expansion packer element shown in FIG. 2 in a compressed, packer set, condition.

FIG. 2C is a perspective view of the high-expansion packer element 40 shown in FIG. 2 in the compressed, packer set, condition. In the compressed, packer set, condition shown in FIG. 2C, the packer element 40 is at maximum engineered compression. A compressed length (CL) of the packer element 40 is up to about 40% of the relaxed length (RL) of the packer element 40, and a compressed diameter (CD) of the packer element 40 is up to about 140% of the outer diameter (OD) of the packer element 40 shown in FIG. 2 in the relaxed condition. The internal diameter (ID) remains the same as the internal diameter of the packer element 40 in the relaxed condition shown in FIG. 2.

Figure 3:
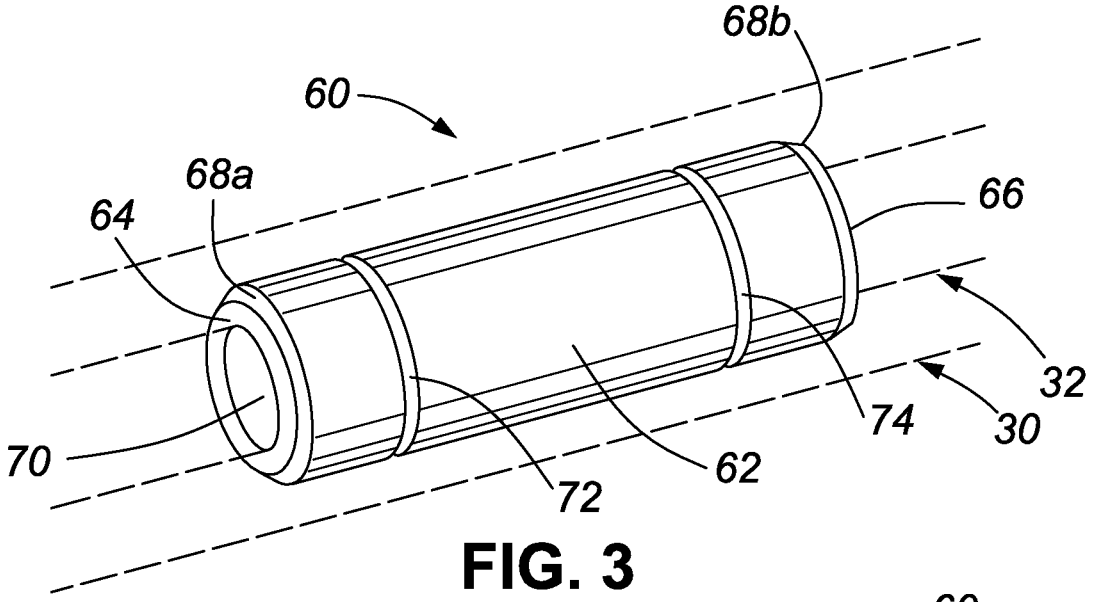
FIG. 3 is a perspective view of yet another embodiment of a high-expansion packer element in accordance with the invention.

FIG. 3 is a perspective view of yet another embodiment of a high-expansion packer element 60 in accordance with the invention. In this embodiment, the packer element 60 is a hollow cylindrical body with an outer surface 62. The packer element 60 also has a first end 64 and a second end 66. The first end 64 has a beveled shoulder 68*a* and the second end 66 as a beveled shoulder 68*b*. The packer element 60 likewise has a sidewall 71 (see FIG. 3B) with an inner surface 70. In this embodiment, the outer surface 62 includes a first external upset 72 and a second external upset 74, the shape of which is best seen in FIG. 3B. The external upsets 72, 74 are generally U-shaped, have radiused edges and respectively have a depth that is about 25% of a thickness of the sidewall 71 of the packer element 60. Each of the external upsets 72, 74 are inset from the respective ends 64, 66 by about 25% of a length of the outer surface 62.

Figure 3A:
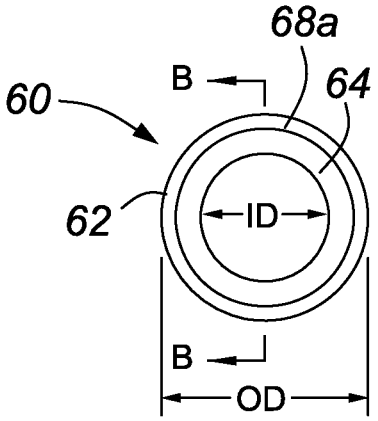
FIG. 3A is an end view of the high-expansion packer element shown in FIG. 3.
Figure 3B:
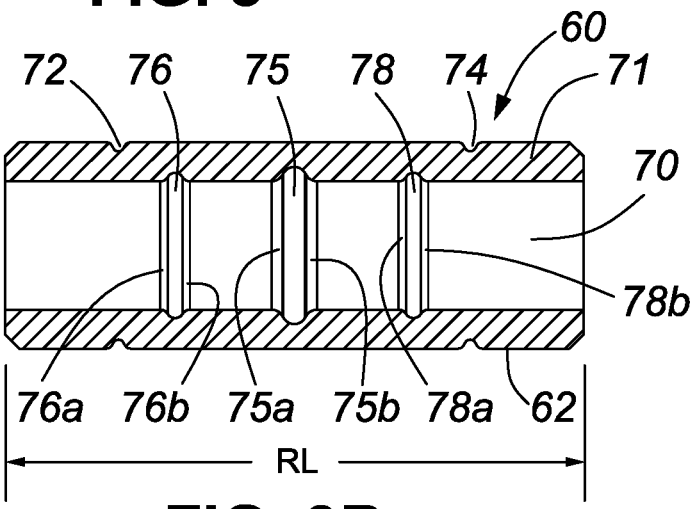
FIG. 3B is a cross-sectional view of the high-expansion packer element shown in FIG. 3, taken along lines B-B shown in FIG. 3A.

FIG. 3A is an end view of the high-expansion packer element 60 shown in FIG. 3, showing the packer element 60 in the relaxed condition. In the relaxed condition the packer element 60 has an internal diameter (ID) that is dependent on an outer diameter of a tubular or mandrel that carries the packer element 60. In the relaxed condition the packer element 60 also has an outer diameter (OD). The outer diameter of the packer element 60 is dependent on an inner diameter of a tubular or open wellbore in which the packer element 60 is to provide an annular seal.

FIG. 3B is a cross-sectional view of the high-expansion packer element 60 shown in FIG. 3, taken along lines B-B shown in FIG. 3A. The inner surface 70 of the packer element 60 includes a first internal upset 76 having first and second radiused edges 76*a*, 76*b*, a second internal upset 75 having radiused edges 75*a*, 75*b*, and a third internal upset 78 having radiused edges 78*a*, 78*b*. The three internal upsets 75, 76 and 78 have the same properties as the three internal upsets described above with reference to FIG. 2B. The first internal upset 76, second internal upset 75 and the third internal upset 78, in conjunction with the two external upsets 72 and 74 are engineered to provide stress relief in the packer element 60 as it is compressed to provide an annular seal, as well as to permit expansion of the outer diameter (OD) of up to at least about 140% of the outer diameter in the relaxed condition. In the relaxed condition, the packer element 10 has a relaxed length (RL). The relaxed length, within the above-noted constraints, is a matter of design choice and dependent at least in part on a function to be served by the packer element 60.

Figure 3C:
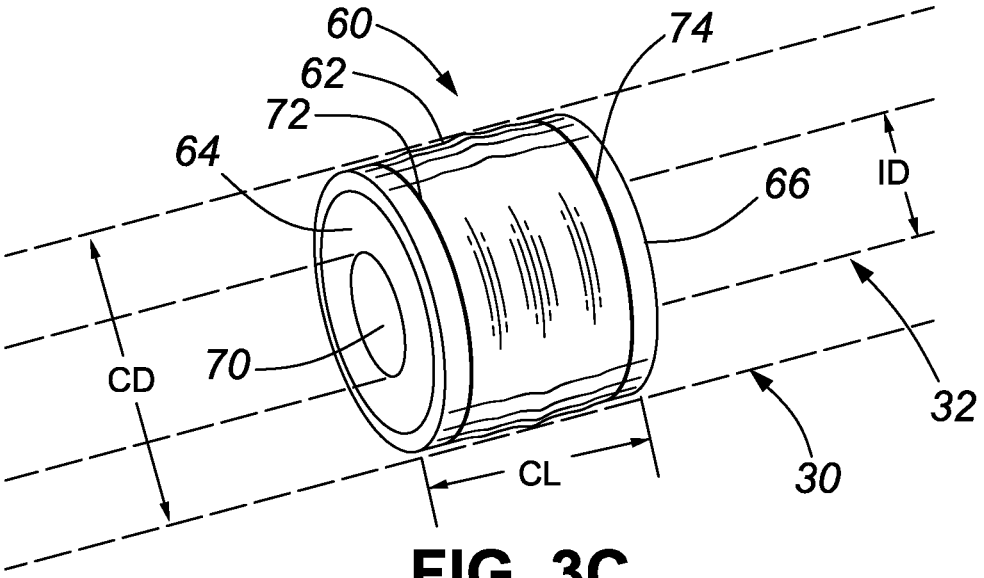
FIG. 3C is a perspective view of the high-expansion packer element shown in FIG. 3 in a compressed, packer set, condition.

FIG. 3C is a perspective view of the high-expansion packer element 60 shown in FIG. 3 in the compressed, packer set, condition. In the compressed, packer set, condition shown in FIG. 3C, the packer element 60 is at maximum engineered compression and the external upsets 72, 74 are compressed tightly closed. A compressed length (CL) of the packer element 60 is about 40% of the relaxed length (RL) of the packer element 60, and a compressed diameter (CD) of the packer element 60 is about 140% of the outer diameter (OD) of the packer element 60 shown in FIG. 3 in the relaxed condition. The internal diameter (ID) remains the same as the internal diameter of the packer element 60 in the relaxed condition shown in FIG. 3.

Figure 4:
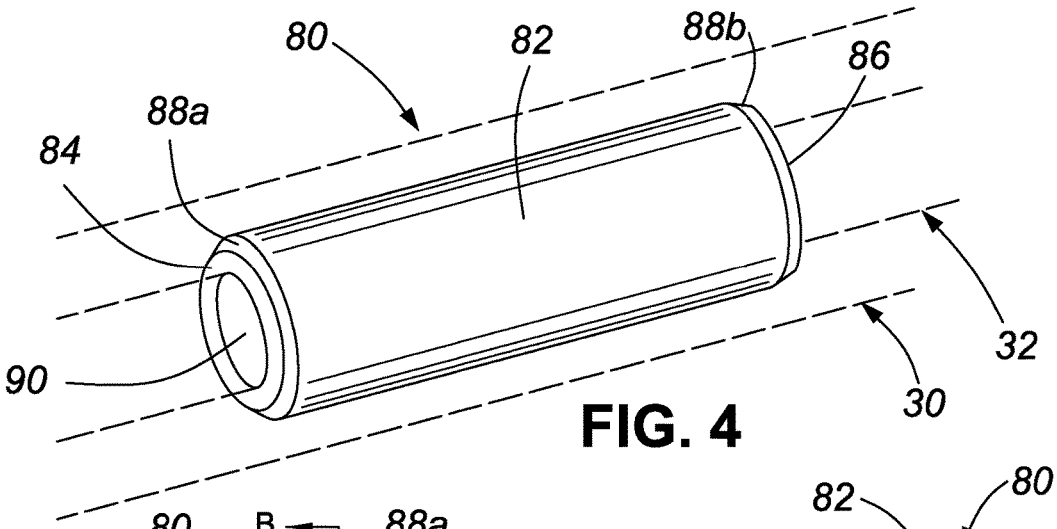
FIG. 4 is a perspective view of a further embodiment of a high-expansion packer element in accordance with the invention.

FIG. 4 is a perspective view of yet a further embodiment of a high-expansion packer element 80 in accordance with the invention. The packer element 80 is a hollow cylindrical body with a smooth outer surface 82, a first end 84 and a second end 86. The first end 84 has a beveled shoulder 88*a* and the second end 86 has a beveled shoulder 88*b*. The packer element 80 also has a sidewall 91 with an inner surface 90, better seen in FIG. 4B.

Figure 4A:
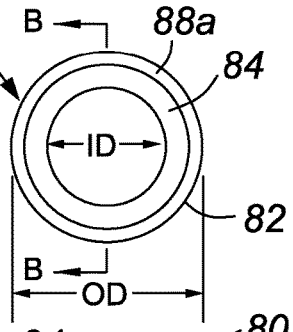
FIG. 4A is an end view of the high-expansion packer element shown in FIG. 4.

FIG. 4A is an end view of the high-expansion packer element 80 shown in FIG. 4, showing the packer element 80 in the relaxed condition. In the relaxed condition the packer element 80 has an internal diameter (ID) that is dependent on an outer diameter of a tubular or mandrel that carries the packer element 80. In the relaxed condition the packer element 80 also has an outer diameter (OD) dependent on an inner diameter of a tubular or wellbore in which the packer element 80 is to be set to provide an annular seal.

Figure 4C:
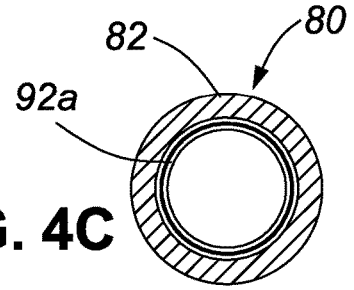
FIG. 4C is a cross-sectional view of the high-expansion packer element shown in FIG. 4, taken along lines C-C shown in FIG. 4B.
Figure 4B:
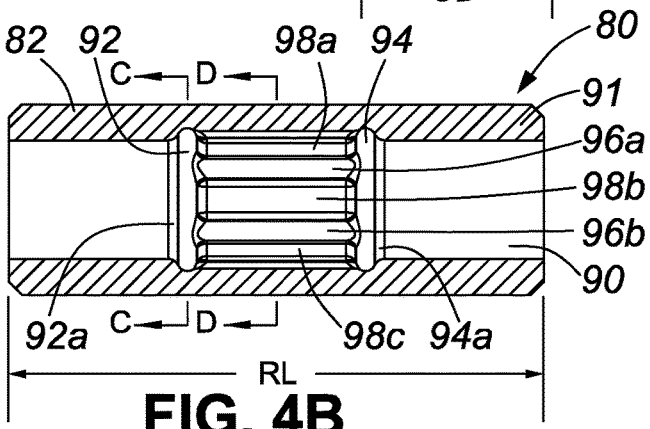
FIG. 4B is a cross-sectional view of the high-expansion packer element shown in FIG. 4, taken along lines B-B shown in FIG. 4A.

FIG. 4B is a cross-sectional view of the high-expansion packer element 40 shown in FIG. 4, taken along lines B-B shown in FIG. 2A. The inner surface 90 of the packer element 80 includes a first internal upset 92 having an outer radiused edge 92*a*, a second internal upset 94 having an outer radiused edge 94*b*. In this embodiment, the first internal upset 92 and the second internal upset 94 are respectively inset from the respective ends 84, 86 by about 33% of a length of the inner surface 90. Transverse grooves 96*a*-96*f*, separated by transverse lands 98*a*-981 (see FIG. 4D), interconnect internal radiused edges of the first internal upset 92 and the second internal upset 94. The transverse grooves 96*a*-96*f* are spaced apart at 60-degree intervals and have a depth of about 33% of a thickness of the sidewall 91. The first internal upset 92, second internal upset 94 and the transverse grooves 96*a*-96*f* are engineered to provide stress relief in the packer element 80 as it is compressed to provide an annular seal, as well as to permit expansion of the outer diameter (OD) of the packer element 80 of up to about 140% of the outer diameter in the relaxed condition. In the relaxed condition, the packer element 80 has a relaxed length (RL). The relaxed length is a matter of design choice, within the above-noted constraints, and dependent on a function to be served by the packer element 10.

Figure 4D:
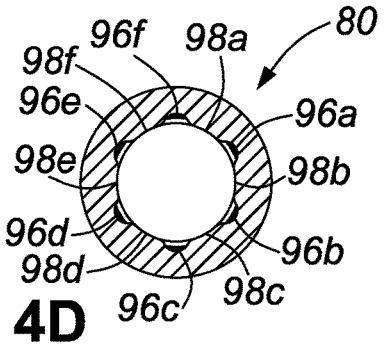
FIG. 4D is a cross-sectional view of the high-expansion packer element shown in FIG. 4, taken along lines D-D shown in FIG. 4B.

FIG. 4C is a cross-sectional view of the high-expansion packer element 80 shown in FIG. 4, taken along lines C-C shown in FIG. 4B, and FIG. 4D is a cross-sectional view of the high-expansion packer element 80 shown in FIG. 4, taken along lines D-D shown in FIG. 4B. As can be seen, a width of the lands 98*a*-98*f* between the transverse grooves 96*a*-96*f* is consistent, as is a width of each U-shaped transverse groove 96*a*-96*f*. Each U-shaped transverse groove 96*a*-96*f* has radiused edges.

Figure 4E:
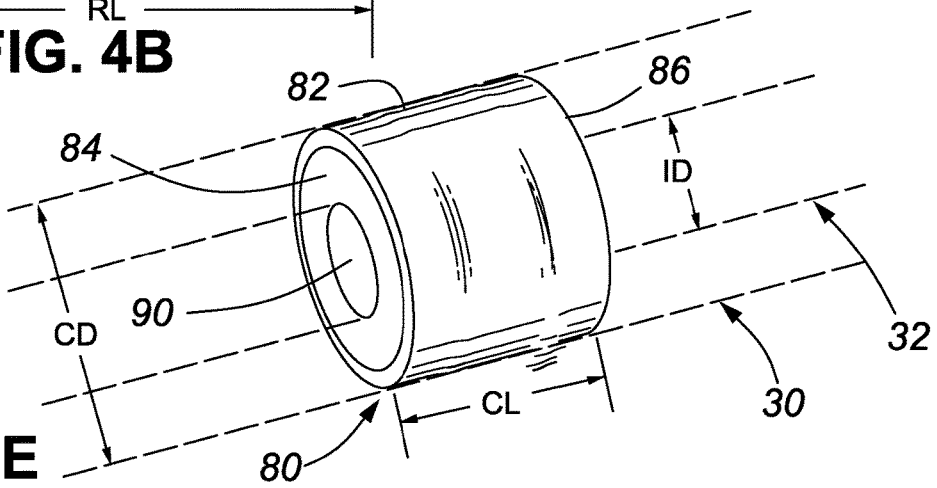
FIG. 4E is a perspective view of the high-expansion packer element shown in FIG. 4 in a compressed, packer set, condition.

FIG. 4E is a perspective view of the high-expansion packer element 80 shown in FIG. 4 in the compressed, packer set condition. In the compressed, packer set condition shown in FIG. 4E, the packer element 80 is at maximum engineered compression. A compressed length (CL) of the packer element 80 is about 40% of the relaxed length (RL) of the packer element 80, and a compressed diameter (CD) of the packer element 80 is up to about 140% of the outer diameter (OD) of the packer element 80 shown in FIG. 4 in the relaxed condition. The internal diameter (ID) remains the same as the internal diameter of the packer element 80 in the relaxed condition shown in FIG. 4.

An outer diameter of the packer elements 10, 40, 60 and 80 at maximum design compression (typically 40% of relaxed condition length) can be calculated using the following formula:

$$D\max = \sqrt{2.5 - \frac{1.5}{A^2}} * OD$$

Where: Dmax=Element Outer Diameter (OD) at maximum compression;

A=Aspect Ratio of element OD/ID in the relaxed condition; and

OD=Element outer diameter in the relaxed condition.

In general, the maximum limit to compressing a packer element is how much internal stress the packer element can withstand before it begins to fail. Experiment has shown that a design based on a compressed length of about 40% of the relaxed length is an optimal maximum. The above-described embodiments of the high-expansion packer element provide a more uniform compressed outer diameter (CD) along the length of the outer surface by having the multiple initiating, bulging locations where the respective internal upsets are located. The internal upsets and optional external upsets provide stress relief because there is more room for the packer element to compress lengthwise and expand radially. Hence, a longevity of the packer elements 10, 40, 60 and 80 is increased. Each of the packer elements 10, 40, 60 and 80 is designed to expand to about the same maximum compressed diameter and provide as much sealing area as possible against a casing or formation (open wellbore) with decreased internal stresses than prior art packer elements of the chemical-resistive type.

The explicit embodiments of the invention described above have been presented by way of example only. The scope of the invention is therefore intended to be limited solely by the scope of the appended claims.

We claim:

1. A high-expansion packer element, comprising a hollow cylindrical body of non-absorptive packer element elastomers having a first end, a second end, a smooth outer surface, and a sidewall having a smooth inner surface, the smooth inner surface of the sidewall including only first and second spaced-apart U-shaped upsets, the respective upsets having a depth of about 40% of the total thickness of the sidewall and radiused side edges to relieve internal stress as the high-expansion packer element is compressed lengthwise and expands radially to a packer set condition.

2. The high-expansion packer element as claimed in claim 1 wherein the first, and second U-shaped upsets partition the inner surface of the sidewall into three sections of substantially equal length.

3. The high-expansion packer element as claimed in claim 1 wherein at maximum engineered compression the high-expansion packer element has a compressed length that is about 40% of a relaxed length and a compressed diameter that is about 140% of a relaxed diameter of the high-expansion packer element.

* * * * *